US006342325B1

(12) United States Patent
Suda et al.

(10) Patent No.: US 6,342,325 B1
(45) Date of Patent: Jan. 29, 2002

(54) PHOTOCONDUCTOR

(75) Inventors: Fumiyuki Suda, Yokohama; Hiroaki Hamanaka, Hiratsuka; Shinichi Nomura, Hadano, all of (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 09/715,005

(22) Filed: Nov. 20, 2000

(30) Foreign Application Priority Data

Dec. 20, 1999 (JP) ..... 11-361125

(51) Int. Cl.[7] ..... G03G 5/14
(52) U.S. Cl. ..... 430/67; 430/66
(58) Field of Search ..... 430/65, 67, 66

(56) References Cited

U.S. PATENT DOCUMENTS 4,686,165 A * 8/1987 Suda et al. ..... 430/64
4,868,078 A * 9/1989 Sakai et al. ..... 430/67
5,314,776 A 5/1994 Nomura et al. ..... 430/65
6,140,631 A * 10/2000 Hamanaka et al. ..... 250/214 R

* cited by examiner

*Primary Examiner*—John Goodrow
(74) *Attorney, Agent, or Firm*—Morgan, Lewis & Bockius LLP

(57) ABSTRACT

The main material of related photoconductors is silicon. When toner is blown onto a photoconductor, spots of $NO_x$ occur, which leads to occurrence of image blurring and image running, and image quality deteriorates substantially. In the present invention, there is provided a photoconductor for use in an electro-photographic photoconductor comprising a conductive substrate, a carrier blocking layer and a photosensitive layer, wherein a value for a polarized element of the most outer surface energy of the photoconductor is 2 [mN/cm] or less. The photoconductor can therefore be used without being heated to 35–45° C., heating equipment is unnecessary, and image blurring and image running do not occur. The present invention also includes defining of the most outer surface energy of the photoconductor having a surface protection layer composed mainly of silicon on the photosensitive layer.

5 Claims, 1 Drawing Sheet

PHOTOCONDUCTOR

This invention claims the benefit of Japanese Patent Application No. HEI 11-361125, filed on Dec. 20, 1999, which is incorporated by reference.

BACKGROUND OF THE INVENTION

1. Field of the Invention

The present invention relates to an electro-photographic photoconductor where energy of a most outer surface of the photoconductor is defined, and more particularly to a configuration where the energy of the most outer surface e.g. a surface protection layer is determined so that dramatically superior images can be obtained by copiers in which such photoconductors are used while both conserving energy and prolonging life-span of such photoconductors.

2. Description of Related Art

FIG. 2 shows an example of a conventional configuration of electro-photographic photoconductor 90 comprising a conductive substrate 91 which is normally an aluminum cylinder, a carrier blocking layer 92 made of a material constituted mainly of silicon, a photosensitive layer 93, also made of a material constituted mainly of silicon, and a surface protection film 94. In many cases, the conductive substrate 91 is formed to be a circle of the cylinder.

The conductive substrate 91 is a base material of the photoconductor 90 on which layers 92, 93 and 94 are formed. The carrier blocking layer 92 prevents carriers from being injected from the conductive substrate 91. The photosensitive layer 93 mainly functions as a photoconductor. When the photosensitive layer 93 receives light, it liberates electron and positive hole pairs, and the electrons moves toward a most outer surface of the photoconductor 90. The surface protection film 94 is provided to make the photosensitive layer 93 resistant to moisture, abrasion and oxidation.

An aluminum cylindrical substrate is provided when the photoconductor 90 is used as an electro-photographic photoconductor in a copier. The surface of the photoconductor 90 is charged to approximately 100,000 volts/cm by a corona discharge etc. The surface of the photoconductor 90 is then exposed to light corresponding to characters or pictures it is desired to copy (surface charge disappears only at portions other than for the characters or pictures it is desired to copy). When toner is then applied to the photoconductor 90, this toner will only become attached to areas where surface charge remains. The toner is then transferred and fixed to a paper so as to provide a copy. Then, surface charge of the photoconductor 90 is removed, the surface of the photoconductor 90 is cleaned, and again can be charged and exposed repeatedly for use in other cycles of copying. This process is well known in the copier industry.

Silicon is given as the main material of the carrier blocking layer 92 and photosensitive layer 93 in the above description. However, other materials such as amorphous materials consisting mainly of amorphous silicon or selenium alloy or so-called OPC's comprising mainly of organic material also may be used as known to a person skilled in the art.

When silicon is used as the main material in an electro-photographic photoconductor 90 of the related configuration, the photoconductor 90 has a long lifetime, because a surface of the photoconductor 90 has high hardness resulting in resistance to peeling-off, wear and abrasion. However, $NO_x$ filming occurs when toner is blown to the photoconductor 90, and also when the photoconductor 90 is charged by corona discharge ("Filming" is a phenomenon an oxide film is generated on a metal surface). The filming is a major reason of resistance decrease of the most outer surface of the photoconductor 90. Surface charge leaks in a lateral direction (i.e. along the surface), and causes resolution decrease. And if the surface charge leaks proceed, blurring or running of the image may occur when an inage is made, and image quality may deteriorate dramatically.

The deterioration of image quality is caused by decrease of ability of the photoconductor 90 to charge. The ability to charge on itself is a major characteristic of a photoconductor. Generally speaking, when charging is carried out to 100,000 volts/cm at the photoconductor surface, a dark resistance of $10^{14}$ to $10^{15}$ Ω·cm is required. However, the oxide film causes this dark resistance to decrease, causing deterioration of image quality.

As a countermeasure for preventing formation of $NO_x$ film, when the photoconductor 90 is composed mainly of silicon, the photoconductor 90 is used under heating with temperature of 35–45 degrees. However, adding an apparatus to provide the heating increases the cost of the image-forming device such as a copier which incorporates the photoconductor 90. Power consumption is also increased to provide this heating, and a space is required in the copier to install such a heating device.

SUMMARY OF THE INVENTION

In order to resolve the aforementioned problems with the related art, in the present invention there is provided a photoconductor comprising a carrier blocking layer and a photosensitive layer formed on a conductive substrate, characterized by that the carrier blocking layer and the photosensitive layer are formed of an amorphous film, and that the surface energy of the most outer surface of the photoconductor can be 20 [mN/cm] or less, a value of a polarized element of surface energy of the most outer surface of the photoconductor is 2 [mN/cm] or less, and that a surface protection layer may also be formed on the photosensitive layer.

DETAILED DESCRIPTION OF THE PREFERRED EMBODIMENT

Figure 1:
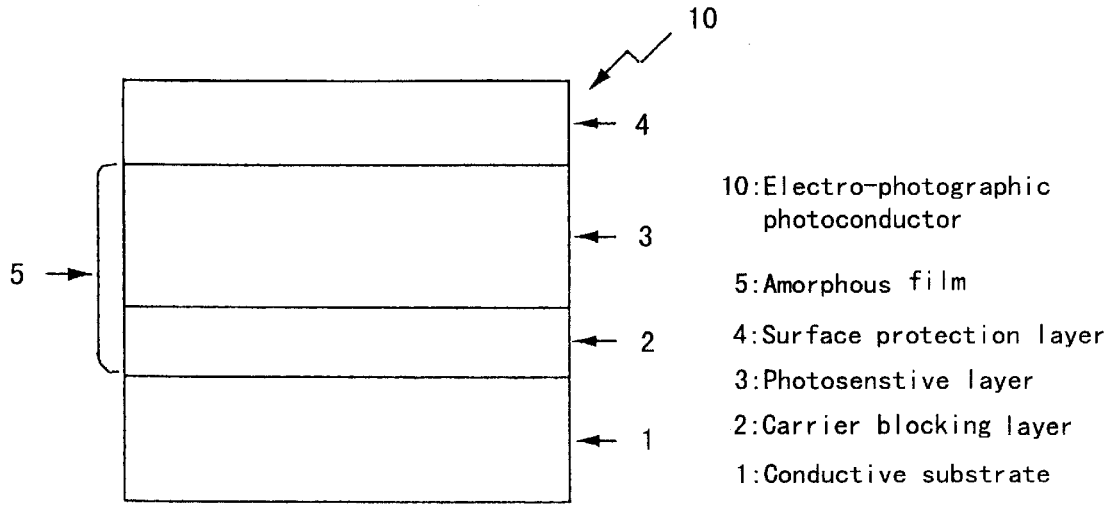
FIG. 1 is a cross-sectional view showing a configuration of an electro-photographic photoconductor of the present invention.
Figure 2:
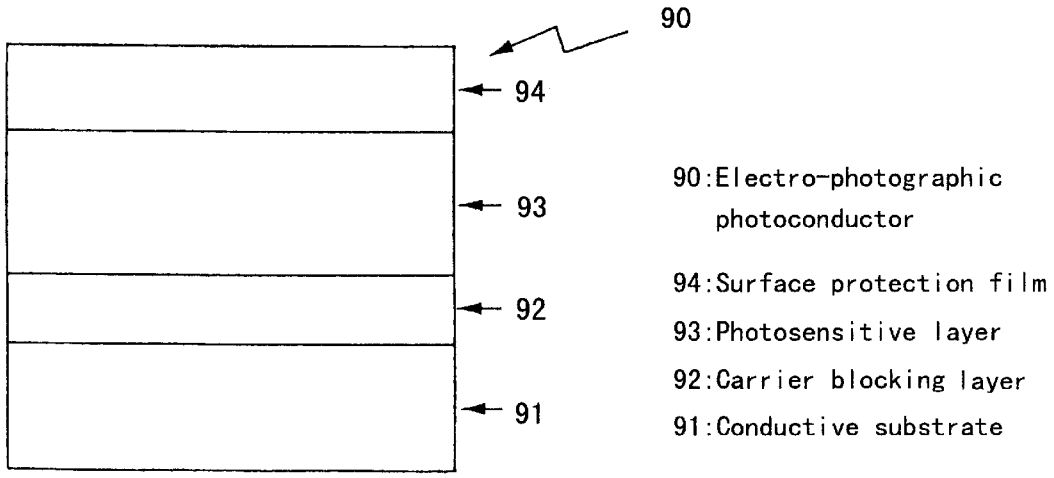
FIG. 2 is a cross-sectional view showing a related example.

Next, a detailed description of the present invention is given based on an embodiment shown in FIG. 1. FIG. 1 shows an electro-photographic photoconductor 10 of the present invention. In this embodiment, a conductive substrate 1 is formed of an aluminum cylinder. As in the related example, a carrier blocking layer 2 is formed on the conductive substrate 1, a photosensitive layer 3 is formed on the carrier blocking layer 2, both constituted by amorphous films 5 and a surface protection layer 4 is provided on the amorphous film 5.

To give an example configuration for this photoconductor, the conductive substrate 1 is made from an aluminum cylinder as specified in JIS3003, the surface of which is polished. The carrier blocking layer 2 is made by adhering $SiH_4$, $H_2$, and $B_2H_6$ to the A1 substrate and the photosensitive layer 3 is made by adhering $SiH_4$, $H_2$, and $B_2H_6$ to the carrier blocking layer 2. $N_2$ may be added to the photosensitive layer 3. The surface protection layer 4 is made of $SiH_4$ and $N_2$. The value for surface energy can be small if fluorine is added to the surface protection layer 4, or if the surface protection layer 4 is coated with teflon.

The point of distinction of the present invention from the example of the related art is that the surface energy of the most outer surface of the photoconductor 10 is determined, or the surface energy of the surface protection layer 4 is determined on the most outer side. "The most outer surface" or "the most outer side" means a surface or a side located to be exposed most closely to illumination. Specifically. the surface energy γ is determined in the following manner.

$\gamma=\gamma p+\gamma d$ $\gamma \leqq 20$ [mN/cm]

$\gamma \leqq 2$ [mN/cm]

γ: Energy of the most outer surface of the (the surface protection layer of the) photoconductor γ p : Polarized element in the most outer surface energy of the (the surface protection layer energy of the) photoconductor γ d : Non-polarized element in the most outer surface energy of the (the surface protection layer energy of the) photoconductor A description is now given of the energy of the most outer surface of the (surface protection layer of the) photoconductor 10. Normally, when the most outer surface is expanded by $Acm^2$ and energy W is consumed, the consumed energy W is stored over the $Acm^2$ of the surface. A value calculated for this stored energy per unit surface area is then referred to as the most outer surface energy, i.e., the most outer surface energy=W/A, and this unit is [mN/cm]. Surface expansion where a surface which has been expanded once can be returned to it's original state is referred to as reversible surface expansion. The energy required at this time is taken to be W. This energy W is stored in the surface area $Acm^2$ which was expanded and its value calculated per unit surface area is referred to as surface free energy. Surface free energy=W/A.

Energy relating to the process of the reversible change is free energy, and W is therefore the free energy required when a surface is to be reversibly expanded by $Acm^2$. The units of this energy are N·m (dyne·m), the units of surface area is $m^2$, and the units for surface free energy are therefore $N \cdot m^{-1}$(dyne $\cdot m^{1}$), which are the same units as for force. Accordingly, the terminology "surface tension" is often used in place of surface free energy.

Inside a substance, molecules and atoms act with surrounding molecules and atoms in a state of mutual equilibrium, and it can therefore be considered that there is no force acting between the molecules and atoms and surrounding molecules and atoms. On the other hand, at the most outer surface, molecules and atoms have a pulling force to inside of the substance because the density of the molecules and atoms at the most outer surface is extremely small. There is therefore a force operating so as to attempt to bring about transition of the molecules and atoms at the most outer surface to more inside of the substance. This kind of force is exhibited as an inclination to tend towards the smallest surface area based on a given volume. Surface tension can also be this kind of force.

This surface tension between intermolecular forces at the surface is comprised of non-polarized force such as dispersion force (non-polarized Van Der Waals force), and polarized forces such as dipolar forces, acidic forces, hydrogen bonding forces and complementary acting base forces. It can be considered to be divided into a d element constituted by inter-molecular force (dispersion force) and a p element of the polarized force. The surface tension γ can therefore also be considered to be:

$$\gamma=\gamma^d+\gamma^p$$

Here, $\gamma^d$ is the dispersion element, and $\gamma^p$ is the polarized force element, of the surface tension.

Experimentation was carried out by making samples of a photoconductor (surface protection layer) with a different most outer surface energy. These samples were made by forming the carrier blocking layers 2 and the photosensitive layers 3 constituted by amorphous films 5 on the conductive substrates 1 under the same conditions, and then forming the surface protection layers 4 under different film-forming conditions.

| Sample | γ [mN/cm] | $\gamma^p$ [mN/cm] |
|---|---|---|
| A | 82 | 37 |
| B | 67 | 11 |
| C | 28 | 8 |
| D | 18 | 4 |
| E | 24 | 0.7 |
| F | 19 | 0.5 |

A print endurance test is then performed where the samples are installed in a copier and left for 24 hours at a temperature of 40° C. at a relative humidity of 90%, after which the photoconductor is operated for 12 hours without being heated while printing at a rate of 50,000 sheets per day. The results for this were as follows.

| Sample | First occurrence of abnormal image | State of image |
|---|---|---|
| A | 3,000 sheets | Image blurring occurs over the entire image |
| B | 47,000 sheets | Blurring starts from dots |
| C | 50,001 sheets | Strip-shaped blurring occurs |
| D | 95,000 sheets | Resolution decreases at dotted portions |
| E | 250,001 sheets | Blurring starts from dotted portions which collectively look like a strip |
| F | — | No blurring for 1,000,000 sheets. |

In the above experiment, the values for γ and $\gamma_p$ are both changed, and small value of $\gamma_p$ makes a particularly substantial influence. As can be seen from the results of experiment, good results can be attained when $\gamma_p$ is equal to 1.0 [mN/cm] or less. This can be understood by the experimental results for E and F.

Even better results can be obtained by making the value of γ to be 20 [mN/cm] or less, while making the value of $\gamma_p$ to be 2 [mN/cm] or less. Looking at the experimental results for F, there were no problems even for 1,000,000 sheets.

The value of the most outer surface energy can be adjusted by, for example, adding fluorine or by providing a teflon coating. The most outer surface energy is made small by adding a large amount of fluorine or by coating a large amount of teflon.

Taking into consideration the above experimental results, good result is obtained by making the most outer surface energy of the surface protection layer small. In particular, the polarized element in the most outer surface energy makes a substantial influence. The polarized element is the intermolecular pulling force exhibited by the hydrogen bonding force. The reason it is better for the most outer surface energy to be smaller is as follows. Intermolucular force is a relative force among the molecules or atoms. Since toner molecule is significantly larger than molecules on the most outer surface of the photoconductor, the intermolecular force is larger for the toner molecules than the molecules at the most outer surface of the photoconductor. Therefore, these toner molecules has pulling force to themselves due to the molecular force. As a results, when the surface energy of the most outer surface is significantly small, blurring does not occur in the image. The present invention defines the most outer surface energy of the photoconductor, and the most outer surface energy of the photoconductor can be similarly defined when there is no surface protection layer.

The operational advantages of the invention will now be described. In the present invention described in the above, there is provided an electro-photographic photoconductor where a photoconductor 10 comprising a carrier blocking layer 2 and a photosensitive layer 3 formed on a conductive substrate 1, the carrier blocking layer 2 and the photosensitive layer 3 are constituted by amorphous films 5 and a value for a polarized element of the most outer surface energy of the photoconductor 10 is 2 [mN/cm] or less. A surface protection layer 4 is also provided on the photosensitive layer 3. In this case, the surface protection layer 4 is the most outer surface of the photoconductor 10. In the configuration according to the present invention., it is no longer necessary to use the photoconductor 10 under heating condition of 35–45° C, and heating equipment is therefore not required. Power can also be conserved because heating is no longer needed. And costs can be reduced still further, because a number of processes involved in providing the heating equipment installation are no longer required. Further, any special equipment etc. is not required in order to obtain Such predetermined values of surface energy, and they can bc obtained merely by adding an amount of fluorine to a protective layer covering the photosensitive surface or adding a prescribed amount of teflon for coating.

It will be apparent to those skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A photoconductor comprising a carrier blocking layer and a photosensitive layer formed in that order on a conductive substrate, wherein the carrier blocking layer and photosensitive layer are formed of an amorphous film, a value of a polarized element of surface energy of the most outer surface of the photoconductor is 2 [mN/cm] or less and a value of surface energy of the most outer surface of the photoconductor is 20 [mN/cm] or less.

2. The photoconductor of claim 1, wherein a surface protection layer is formed on the photosensitive layer and the surface protection layer is taken to be the most outer surface.

3. The photoconductor of claim 2, wherein a main element of the surface protection layer is silicon.

4. The photoconductor of claim 1, wherein a surface protection layer is formed on the photosensitive layer and the surface protection layer is taken to be the most outer surface.

5. The photoconductor of claim 4, wherein a main element of the surface protection layer is silicon.

* * * * *